US005104140A

United States Patent [19]

Anderson

[11] Patent Number: 5,104,140

[45] Date of Patent: Apr. 14, 1992

[54] OBLIQUELY GROOVED SNOW SKIS

[75] Inventor: Eric C. Anderson, Bozeman, Mont.

[73] Assignee: Anderson Research Laboratory, Bozeman, Mont.

[21] Appl. No.: 709,619

[22] Filed: Jun. 3, 1991

[51] Int. Cl.[5] ..... A63C 5/04

[52] U.S. Cl. ..... 280/609; 280/608

[58] Field of Search ..... 280/601, 604, 607, 608, 280/609, 606, 614, 615; 441/68

[56] References Cited

U.S. PATENT DOCUMENTS

| | | | |
|---|---|---|---|
| 3,918,114 | 11/1975 | Schmitt | 280/609 |
| 4,175,766 | 11/1979 | Barwin | 280/608 |
| 4,262,925 | 4/1981 | Plenk | 280/604 |
| 4,305,603 | 12/1981 | Muller et al. | 280/607 |
| 4,509,771 | 4/1985 | Nussbaumer | 280/609 |

FOREIGN PATENT DOCUMENTS 944646 4/1949 France .

*Primary Examiner*—Andres Kashnikow
*Assistant Examiner*—Richard Camby
*Attorney, Agent, or Firm*—Merchant, Gould, Smith, Edell, Welter & Schmidt

[57] ABSTRACT

This invention provides a set of downhill snow skis having frontwardly converging internal edges and grooves formed in the running surfaces thereof. In particular, at least one groove is formed in each of the running surfaces, extending from a point proximate the outer rear portion of each ski to a point proximate the inner front portion of each ski. The frontwardly converging grooves make it easier to learn how to downhill ski and thus, facilitate downhill skiing lessons for beginning skiers. The present invention also provides a set of cross-country snow skis having rearwardly converging internal edges and grooves formed in the running surfaces thereof. In particular, at least one groove is formed in each of the running surfaces, extending from a point proximate the inner rear portion of each ski to a point proximate the outer front portion of each ski. The rearwardly converging grooves make it easier to perform certain cross-country skiing maneuvers and thus, facilitate cross-country skiing lessons for beginning skiers.

12 Claims, 1 Drawing Sheet

OBLIQUELY GROOVED SNOW SKIS

FIELD OF THE INVENTION

The present invention relates to snow skis and more particularly, to downhill skis having frontwardly converging grooves formed in the running surfaces thereof, and cross-country skis having rearwardly converging grooves formed in the running surfaces thereof.

BACKGROUND OF THE INVENTION

Snow skiing is a popular sport and pastime that is recognized to be strenuous and exhilarating. Both downhill and cross-country skiing require leg strength, balance, and technique, all of which improve with practice. Unfortunately, many novices take to the slopes and/or the countryside each year only to be disappointed by their lack of immediate success in learning how to ski. Moreover, others never even attempt to learn how to ski because they are intimidated by the prospect, and still others, including the elderly and/or handicapped, may not be allowed an opportunity to learn because skiing is deemed to be too difficult and/or dangerous for them. The present invention makes it easier, safer, and less physically demanding to learn how to snow ski, either downhill or cross-country.

First, as those skilled in the art will recognize, beginning downhill skiers are taught to position their skis in a "snow plow" orientation as they first learn to move down a hill, back and forth across the fall line. The "snow plow" orientation involves positioning the tips of the skis relatively close together and the rear portions of the skis relatively spread apart. In order to "snow plow" with prior art downhill skis, the beginning skier must tilt the skis onto their edges and shift weight between the skis in order to control his or her speed and direction. The required tilting of the skis onto their edges can be quite an obstacle for many beginning downhill skiers. This difficulty is effectively reduced by Applicant's downhill skis, which tend toward a "snow plow" orientation and facilitate directional changes, thus reducing the need for tilting the skis onto their edges.

Second, as those skilled in the art will recognize, basic cross-country skiing techniques include "skating" and "herringbone" maneuvers. In order to perform these techniques with prior art cross-country skis, the cross-country skier must angle the tips of the skis away from one another, forming an angle of approximately 30° therebetween in order to "skate" and an angle of approximately 90° therebetween in order to "herringbone." The required angling of the skis as much as 45° from the direction of travel can be quite an obstacle for many beginning cross-country skiers. This difficulty is reduced by Applicant's cross-country skis, which have a "built-in" angle relative to the direction of travel, thus reducing the need for angling the skis.

SUMMARY OF THE INVENTION

According to one embodiment of the present invention, there is a set of downhill snow skis, each of which is comprised of a substantially flat elongate body integrally joined at its front end to an upwardly curved front portion or tip. Each of the elongate bodies is defined by inner and outer edges, an upper surface, a running surface, and front and rear ends. In an operative orientation, the inner edges of the left and right skis face one another, and the running surfaces lay substantially flat upon the ground. Obliquely oriented grooves are formed in the running surfaces in such a manner that the grooves extend from points proximate the outer edges of the rear ends of the skis to points proximate the inner edges of the front ends of the skis. Thus, when viewed together, the grooves formed in the set of downhill skis may be said to be "frontwardly converging."

In operation, the frontwardly converging grooves reduce the need to tilt the skis onto their edges in order to control downhill speed and direction, so the beginning skier can concentrate on shifting his or her weight between the skis. Essentially, each groove provides a pair of opposing internal edges that, by reason of their oblique orientation relative to the longitudinal axes of the skis, tend to urge the skis into a "snow plow" orientation. Also, the frontwardly converging internal edges and grooves make it easier for the skier to change direction because the effect of the obliquely oriented internal edges and groove formed in a given ski is magnified when the skier's weight is shifted to that ski. Thus, turning left can be accomplished by the skier shifting his or her weight to the right ski, and turning right can be accomplished by the skier shifting his or her weight to the left ski.

The present invention also provides a method of teaching a person how to downhill ski, using pairs of the downhill snow skis substantially as described in the preceding paragraphs. The pairs of skis should have frontwardly converging internal edges and grooves of various depths and angles formed in the running surfaces, and a beginning skier should initially be fitted with a pair of skis having relatively deep and angled grooves. As noted above, the frontwardly converging grooves help maintain the skis in a "snow plow" orientation, and they also make it easier for the skier to change direction. The guidance provided by the frontwardly converging internal edges and grooves may prove particularly helpful in teaching handicapped and uncoordinated people to downhill ski, because simple instructions of "Right Foot" and "Left Foot" can keep the individual traveling substantially in the desired direction. Using the frontwardly converging grooved skis, the beginner skier is also more likely to have his or her weight forward (than would be the case with conventional skis), which should further accelerate the beginner's learning curve.

As an individual's skiing ability improves, he or she is fitted with a pair of skis having grooves that are somewhat less deep and/or less angled than the previous pair of skis. At this stage, the person is instructed to rely less on the internal edges and grooves and more on the inner and outer edges of the skis. By gradually advancing to skis having shallower and/or less angled grooves, an individual will eventually no longer require the grooves, though it is not necessary that the person "graduate" to skis having no grooves in order for that person to enjoy downhill skiing.

In another embodiment, the present invention provides a set of cross-country snow skis, each of which is comprised of a substantially flat elongate body integrally joined at its front end to an upwardly curved front portion or tip. Each of the elongate bodies is defined by inner and outer edges, an upper surface, a running surface, and front and rear ends. In an operative orientation, the inner edges of the left and right skis face one another, and the running surfaces lay substantially flat upon the ground. Obliquely oriented grooves are formed in the running surfaces in such a manner that the grooves extend from points proximate the inner edges of the rear ends of the skis to points proximate the outer edges of the front ends of the skis. Thus, when viewed together, the grooves formed in the set of cross-country skis may be said to be "rearwardly converging."

In operation, the rearwardly converging grooves reduce the magnitude of the ski angle required for performing skating and herringbone maneuvers, so the beginning cross-country skier can gradually develop his or her technique. Essentially, each groove provides a pair of opposing internal edges that, by reason of their oblique orientation relative to the longitudinal axes of the skis, provide a "built-in" angle relative to the desired direction of travel.

The present invention further provides a method of teaching a person how to cross-country ski, using pairs of the cross-country snow skis substantially as described in the preceding paragraphs. The pairs of skis should have rearwardly converging internal edges and grooves of various depths and angles formed in the running surfaces, and a beginning skier should initially be fitted with a pair of skis having relatively deep and angled grooves. As noted above, the rearwardly converging grooves are angled away from the direction of travel to facilitate skating and herringbone maneuvers, and thus, the beginning skier need not spread the tips of the skis at as great an angle relative to the direction of travel.

As an individual improves, he or she is fitted with a pair of skis having grooves that are somewhat less deep and/or less angled than the previous pair of skis. At this stage, the person is required to place the skis at a greater angle relative to the direction of travel, but it should be somewhat easier to do so because the individual has practiced his or her technique on the previous set of skis. By gradually advancing to skis having shallower and/or less angled grooves, an individual will eventually no longer require the grooves, though it is not necessary that the person "graduate" to skis having no grooves in order for that person to enjoy cross-country skiing.

BRIEF DESCRIPTION OF THE DRAWING

Referring to the Figures, wherein like numerals represent like parts throughout the several views.

DETAILED DESCRIPTION OF PREFERRED EMBODIMENTS

Figure 1:
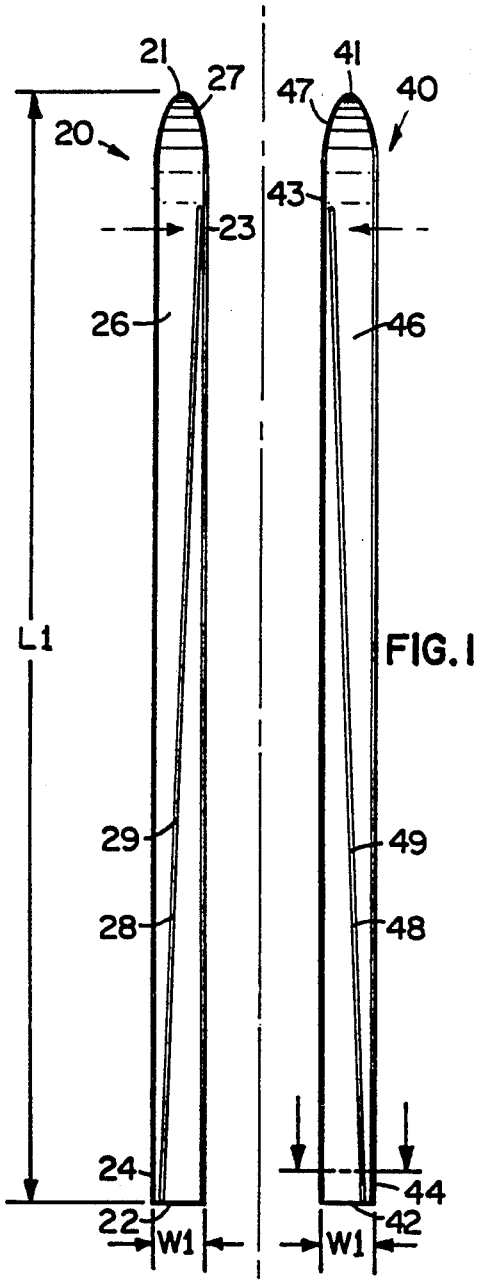
FIG. 1 is a bottom view of a set of downhill snow skis constructed according to the principles of the present invention.

FIG. 1 is a bottom view of a set of downhill snow skis 20 and 40 constructed according to the principles of the present invention. Both the right ski 20 and the left ski 40 extend a length L1 from front ends or tips 21 and 41 to rear ends 22 and 42, respectively. Also, the right ski 20 and the left ski 40 span a width W1 (typically narrowing somewhat in the middle portion between the front and rear ends) from inner edges 23 and 43 to outer edges 24 and 44, respectively. Additionally, both skis 20 and 40 have a thickness T1 (typically thinning significantly at the front and rear ends), which is measured between top sides (not shown for right ski 20, but shown in FIG. 2 at 45 for left ski 40) and running surfaces 26 and 46, respectively. Considering the relative length L1, width W1, and thickness T1 of the skis 20 and 40, they can be said to be substantially flat and elongate. In one particular embodiment, the length L1 is 190 cm; the width W1 is 7.5 cm at the front and rear ends and 6.0 cm at the midpoint therebetween; and the thickness TI varies from 0.5 cm at the front and rear ends to 2.0 cm at the midpoint therebetween. However, those skilled in the art will recognize that the invention is not limited to these dimensions, and that downhill skis may vary significantly depending on the style of the skis, as well as an individual's particular needs.

The running surfaces 26 and 46 extend almost the entire length L1 of the skis 20 and 40, extending from the rear ends 22 and 42 up to and integrally joining the upwardly curved front portions 27 and 47, respectively. Oblique grooves 28 and 48 extend the length of the running surfaces 26 and 46 in a substantially straight line from points proximate the outer edges 24 and 44 at the rear ends 22 and 42 to points proximate the inner edges 23 and 43 where the running surfaces 26 and 46 join the upwardly curved front portions 27 and 47, respectively. Thus, when viewed together, the oblique grooves 28 and 48 may be said to be "frontwardly converging." The oblique grooves 28 and 48, which may be said to be internal in relation to the skis themselves, are bordered by pairs of opposing internal edges (designated generally as 29 and 49), which internal edges essentially define the size and shape of the grooves 28 and 48. The magnitude of the angle of the oblique grooves 28 and 48 can be measured relative to the edges 23, 24, 43, and 44 or relative to the longitudinal axes of the skis 20 and 40, which axes are parallel to these edges.

The oblique grooves 28 and 48 are of uniform semicircular cross-section, though other cross-sectional shapes, including triangular, rectangular, and trapezoidal, may also be employed. Also, the configuration of the grooves and their orientation relative to the edges of the skis may vary. For example, the grooves in the running surfaces need not be entirely straight nor extend the entire length of the running surfaces in order to provide desired effects. In the embodiment shown, the grooves 28 and 48 have a diameter of 0.5 cm, and the relative angle between the grooves 28 and 48 and the edges 24 and 44 (or the longitudinal axes of the skis) is 2.3 degrees. However, as discussed below, the size and angle of the grooves will vary according to the abilities of the individual using Applicant's skis.

Figure 2:
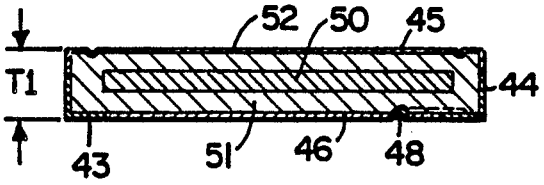
FIG. 2 is a sectioned view of one of the downhill snow skis shown in FIG. 1.

Referring to FIG. 2, in the embodiment shown, the ski 40 (as well as the ski 20) has a honeycomb core 50, a wood body 51, a laminated finish 52, and metal edges 43 and 44. Those skilled in the art will recognize that the present invention is not limited to these materials, but that skis according to the principles of the present invention may be manufactured from a variety of materials, including metal, plastic, composite material, or some combination thereof. Also, the grooves 28 and 48 may be formed in various manners, including routering, molding, or pressing.

In operation, the frontwardly converging grooves 28 and 48 reduce the need to tilt the skis onto their edges 23, 24, 43, and 44 in order to control downhill speed and direction, so the beginning downhill skier can concentrate on shifting his or her weight between the skis. By reason of their oblique orientation relative to the longitudinal axes of the skis, the frontwardly converging internal edges 29 and 49 and grooves 28 and 48 interact with the snow to urge the skis into a "snow plow" orientation, with the upwardly curved front portions 27 and 47 relatively close together and the rear ends 22 and 42 relatively spread apart. (See arrows in FIG. 1). Also, the frontwardly converging internal edges 29 and 49 and grooves 28 and 48 make it easier for the skier to change direction because the effect of the obliquely oriented internal edges and groove formed in a given ski is magnified when the skier's weight is shifted to that ski. Thus, turning left can be accomplished by the skier shifting his or her weight to the right ski, and turning right can be accomplished by the skier shifting his o her weight to the left ski.

The frontwardly converging grooves 28 and 48 can also prove useful to more advanced skiers for various reasons, including learning and practicing more difficult maneuvers, such as the "telemark turn," another term recognized by those skilled in the art. The telemark turn is used by advanced skiers in deep powder snow and requires the skier to shift weight to the inner edge of the downhill ski and bring the tip of the uphill ski toward the downhill foot. The frontwardly converging internal edges 29 and 49 and grooves 28 and 48 facilitate the necessary movements of the skis in performing the telemark turn and thus, can be helpful to an advanced skier seeking to master this maneuver.

The present invention also provides a method of teaching a person how to downhill ski, using pairs of the downhill snow skis substantially as described in the preceding paragraphs. The pairs of skis to be used for instructional purposes should have frontwardly converging internal edges and grooves of various depths and angles formed in the running surfaces, and a beginning skier should initially be fitted with a pair of skis having relatively deep and angled grooves. Alternatively, the beginning skier could be fitted with skis having more than one frontwardly converging groove formed in each running surface. As noted above, the internal edges and grooves help maintain the skis in a "snow plow" orientation, and they also make it easier for the skier to change direction. The guidance provided by the frontwardly converging grooves may prove particularly helpful in teaching handicapped and uncoordinated people, because simple instructions of "Right Foot" and "Left Foot" can keep the individual traveling substantially in the desired direction. Using the frontwardly converging grooved skis, the beginner skier is also more likely to have his or her weight forward (than would be the case with conventional skis), which should further accelerate the beginner's learning curve.

As an individual improves, he or she is fitted with a pair of skis having grooves that are somewhat less deep and/or less angled than the previous pair of skis. At this stage, the person is instructed to rely less on the grooves and more on the inner and outer edges of the skis. By gradually advancing to skis having shallower and/or less angled grooves, an individual will eventually no longer require the grooves, though it is not necessary that the person "graduate" to skis having no grooves in order for that person to enjoy downhill skiing. Also, under certain circumstances, it may be desirable for skiers of all levels of skill to use skis having the frontwardly converging internal edges and grooves formed therein in order to realize the advantages provided thereby. For example, the more advanced skier may require or desire assistance in learning and mastering the telemark turn.

Figure 3:
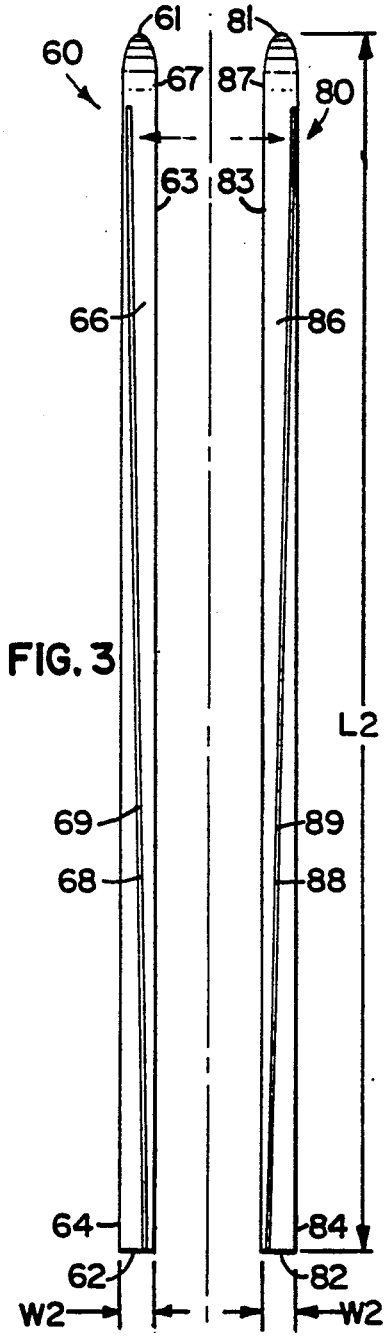
FIG. 3 is a bottom view of a set of cross-country snow skis constructed according to the principles of the present invention.

FIG. 3 is a bottom view of a set of cross-country snow skis 60 and 80 constructed according to the principles of the present invention. Both the right ski 60 and the left ski 80 extend a length L2 from front ends or tips 61 and 81 to rear ends 62 and 82, respectively. Also, the right ski 60 and the left ski 80 span a width W2 (typically narrowing slightly at the front and rear ends) from the inner edges 63 and 83 to outer edges 64 and 84, respectively. Additionally, both skis 60 and 80 have a thickness T2 (typically thinning significantly at the front and rear ends), which is measured between top sides (not shown) and running surfaces 66 and 86, respectively. Considering the relative length L2, width W2, and thickness T2, the skis 60 and 80 can be said to be substantially flat and elongate. In one particular embodiment, the length L2 is 205 cm; the width W2 is 4.8 cm at the front and rear ends and 5.0 cm at the midpoint therebetween; and the thickness T2 varies from 0.5 cm at the front and rear ends to 2.5 cm at the midpoint therebetween. However, those skilled in the art will recognize that the invention is not limited to these dimensions and that cross-country skis may vary significantly depending on the style of the skis, as well as an individual's particular needs.

The running surfaces 66 and 86 extend almost the entire length L2 of the skis 60 and 80, extending from the rear ends 62 and 82 up to and integrally joining the upwardly curved front portions 67 and 87, respectively. Oblique grooves 68 and 88 extend the length of the running surfaces 66 and 86 in a substantially straight line from points proximate the inner edges 63 and 83 at the rear ends 62 and 82 to points proximate the outer edges 64 and 84 where the running surfaces 66 and 86 join the upwardly curved front portions 67 and 87, respectively. Thus, when viewed together, the oblique grooves 68 and 88 may be said to be "rearwardly converging." The oblique grooves 68 and 88, which may be said to be internal in relation to the skis themselves, are bordered by pairs of opposing internal edges (designated generally as 69 and 89), which internal edges essentially define the size and shape of the grooves 68 and 88. The degree of angle of the oblique grooves 68 and 88 can be measured relative to the edges 63, 64, 83, and 84 or relative to the longitudinal axes of the skis 60 and 80, which axes are parallel to these edges.

The oblique grooves 68 and 88 are of uniform semicircular cross-section, though other cross-sectional shapes, including triangular, rectangular, and trapezoidal may also be employed. The configuration of the grooves and their orientation relative to the edges of the skis may vary. Again, the grooves in the running surfaces need not be entirely straight nor extend the entire length of the running surfaces in order to provide desired effects. In the embodiment shown, the grooves 68 and 88 have a diameter of 0.5 cm, and the relative angle between the grooves 68 and 88 and the edges 64 and 84 (or the longitudinal axes of the skis) is 1.4 degrees. However, as discussed below, the size and angle of the grooves will vary according to the abilities of the individual using Applicant's skis. Also, the various alternatives for manufacturing the skis and forming the grooves in the running surfaces discussed above in connection with Applicant's downhill skis are also available for Applicant's cross-country skis.

In operation, the rearwardly converging grooves 68 and 88 reduce the magnitude of the angle required for the ski tips 61 and 81 in connection with skating and herringbone maneuvers, so the beginning cross-country skier can gradually develop his or her technique. By reason of their oblique orientation relative to the longitudinal axes of the skis, the rearwardly converging internal edges 69 and 89 and grooves 68 and 88 provide a "built-in" angle relative to the desired direction of travel. The interaction of the internal edges 69 and 89 and grooves 68 and 88 with the snow causes the skis 60 and 80 to function as if they were obliquely oriented relative to the direction of travel (in the direction indicated by the arrows in FIG. 3).

The present invention further provides a method of teaching a person how to cross-country ski, using pairs of the cross-country snow skis substantially as described in the preceding paragraphs. The pairs of skis to be used for instructional purposes should have rearwardly converging internal edges and grooves of various depths and angles formed in the running surfaces, and a beginning skier should initially be fitted with a pair of skis having relatively deep and angled grooves. Alternatively, the beginning skier could be fitted with skis having more than one rearwardly converging groove formed in each running surface. As noted above, the rearwardly converging internal edges and grooves reduce the magnitude of the angle required to perform skating and herringbone maneuvers. As a result, the beginner skier need not place the skis at as great an angle relative to the direction of travel, and the relief provided may allow individuals to cross-country ski, where they would not otherwise be able to effectively do so.

As an individual improves, he or she is fitted with a pair of skis having grooves that are somewhat less deep and/or less angled than the previous pair of skis. At this stage, the person is required to place the skis at a greater angle relative to the direction of travel, but it should be somewhat easier to do so because the individual has practiced the technique. By gradually advancing to skis having shallower and less angled grooves, an individual will eventually no longer require the grooves, though it is not necessary that the person "graduate" to skis having no grooves in order for that person to enjoy cross-country skiing. Also, under certain circumstances, it may be desirable for skiers of all levels of skill to use skis having rearwardly converging internal edges and grooves formed therein in order to realize the advantages provided thereby.

While the invention has been described with respect to two preferred embodiments, it is understood by those skilled in the art that the invention is not limited to such designs nor any specifics of construction. These and other variations of the invention will be apparent to those skilled in the art, and the present invention is to be limited only by the appended claims.

What is claimed is:

1. A set of downhill snow skis, comprising:

(a) a first snow ski, comprising:

(i) a substantially flat elongate body having front and rear ends, inner and outer edges, an upper surface, and a running surface;

(ii) an upwardly curved front portion integrally joined to said front end of said substantially flat elongate body of said first snow ski; and (iii) a groove formed in said running surface of said first snow ski, and extending from a point proximate said outer edge and said rear end of said first snow ski to a point proximate said inner edge and said front end of said first snow ski; and (b) a second snow ski, comprising:

(i) a substantially flat elongate body having front and rear ends, inner and outer edges, an upper surface, and a running surface, wherein in an operative orientation, said inner edge of said first snow ski faces toward said inner edge of said second snow ski;

(ii) an upwardly curved front portion integrally joined to said front end of said substantially flat elongate body of said second snow ski; and (iii) a groove formed in said running surface of said second snow ski and extending from a point proximate said outer edge and said rear end of said second snow ski to a point proximate said inner edge and said front end of said second snow ski, whereby in operation said upwardly curved front portions of said first and second snow skis tend to remain relatively close together, and said rear ends of said first and second snow skis tend to remain relatively spread apart.

2. A set of downhill snow skis according to claim 1, wherein said grooves of said first and second snow skies have a semi-circular cross-section.

3. A set of downhill snow skis according to claim 2, wherein said grooves of said first and second snow skis have a diameter of one-half centimeter.

4. A set of downhill snow skis according to claim 1, wherein said grooves of said first and second snow skis are straight.

5. A set of downhill snow skis according to claim 1, wherein more than one said groove is formed in each of said running surfaces of said first and second snow skis.

6. A set of cross-country snow skis, comprising:

(a) a first snow ski, comprising:

(i) a substantially flat elongate body having front and rear ends, inner and outer edges, an upper surface, and a running surface;

(ii) an upwardly curved front portion integrally joined to said front end of said substantially flat elongate body of said first snow ski; and (iii) a groove formed in said running surface of said first snow ski and extending from a point proximate said inner edge and said rear end of said first snow ski to a point proximate said outer edge and said front end of said first snow ski; and (b) a second snow ski, comprising:

(i) a substantially flat elongate body having front and rear ends, inner and outer edges, an upper surface, and a running surface, wherein in an operative orientation, said inner edge of said first snow ski faces toward said inner edge of said second snow ski;

(ii) an upwardly curved front portion integrally joined to said front end of said substantially flat elongate body of said second snow ski; and (iii) a groove formed in said running surface of said second snow ski and extending from a point proximate said inner edge and said rear end of said second snow ski to a point proximate said outer edge and said front end of said second snow ski, whereby in operation said grooves of said first and second snow skis facilitate skating and herringbone maneuvers.

7. A set of cross-country snow skis according to claim 6, wherein said grooves of said first and a second snow skis have a semi-circular cross-section.

8. A set of cross-country snow skis according to claim 7, wherein said grooves of said first and second snow skis have a diameter of one-half centimeter.

9. A set of cross-country snow skis according to claim 6, wherein said grooves of said first and second snow skis are straight.

10. A set of cross-country snow skis according to claim 6, wherein more than one said groove is formed in each of said running surfaces of said first and second snow skis.

11. A method of teaching a person how to downhill snow ski, using pairs of downhill snow skis having inner and outer edges, and running surfaces with obliquely oriented grooves formed therein which grooves are frontwardly converging when viewed together, comprising the steps of:

(a) beginning the person with a first pair of skis with frontwardly converging grooves that are relatively deep and oblique wherein the person can be instructed to shift weight to the right ski to turn left and to shift weight to the left ski to turn right;

(b) advancing the person to a pair of skis with frontwardly converging grooves that are somewhat less deep and less oblique than the first pair of skis, wherein the person can be instructed to rely less on the frontwardly converting grooves and more on the inner and outer edges to turn left and right; and (c) repeating said advancing step until the person no longer requires skis with frontwardly converging grooves to turn left and right.

12. A method of teaching a person how to cross-country snow ski in a desired direction, using pairs of cross-country snow skis, having running surfaces with obliquely oriented grooves formed therein, which grooves are rearwardly converging when viewed together, comprising the steps of:

(a) beginning the person with a first pair of skis with rearwardly converging grooves that are relatively deep and oblique wherein the person can be instructed to place the skis at less than an optimum angle relative to the desired direction of travel and successfully perform skating and herringbone maneuvers;

(b) advancing the person to a pair of skis with rearwardly converging grooves that are somewhat less deep and less oblique than the first pair of skis, wherein the person can be instructed to rely less on the rearwardly converging grooves and more on placing the skis at the optimum angle to perform skating and herringbone maneuvers; and (c) repeating said advancing step until the person no longer requires skis with rearwardly converging grooves to perform skating and herringbone maneuvers.

* * * * *

UNITED STATES PATENT AND TRADEMARK OFFICE

CERTIFICATE OF CORRECTION

PATENT NO. : 5,104,140

DATED : April 14, 1992

INVENTOR(S) : Eric C. Anderson

It is certified that error appears in the above-identified patent and that said Letters Patent is hereby corrected as shown below:

Column 8,

In claim 2, line 21, "skies" should read -- skis --.

Column 9,

In claim 11 (b), line 26, "converting" should read -- converging --.

Signed and Sealed this

Thirteenth Day of July, 1993

*Attest:*

Michael K. Kirk

MICHAEL K. KIRK

*Attesting Officer*

*Acting Commissioner of Patents and Trademarks*